United States Patent [19]

Gotanda

[11] 4,376,379

[45] Mar. 15, 1983

[54] LOCKING DEVICE

[76] Inventor: Motohiro Gotanda, No. 1802-10, Nakabyo Abiko City, Chiba Prefecture, Japan

[21] Appl. No.: 179,824

[22] Filed: Aug. 20, 1980

[30] Foreign Application Priority Data

Aug. 23, 1979 [JP] Japan ..... 54-106651

[51] Int. Cl.[3] ..... E05B 63/14

[52] U.S. Cl. ..... 70/118; 70/432; 292/37

[58] Field of Search ..... 70/118, 120, 113, 432; 292/37, 32, 169.16

[56] References Cited

U.S. PATENT DOCUMENTS

| | | | |
|---|---|---|---|
| 586,675 | 7/1897 | Taylor | 272/37 |
| 1,545,962 | 7/1925 | Klein | 70/118 |
| 1,661,584 | 3/1928 | Tozer | 70/118 |
| 1,777,105 | 9/1930 | Perebenda | 70/118 |
| 2,357,551 | 9/1944 | Schlage | 292/169.16 |
| 2,370,691 | 3/1945 | Schlage | 292/37 |
| 3,942,345 | 3/1976 | Sasahara | 70/276 |

*Primary Examiner*—William E. Lyddane

*Attorney, Agent, or Firm*—Larson and Taylor

[57] ABSTRACT

A locking device comprising driving members driven by a thumb turn from insie a room and by a key from outside the room, dead bolts brought into engagement with the driving members to advance or retreat to lock or unlock the room, and switches for detecting the advance and retreat of the dead bolts. Said dead bolts are formed by dividing the thickness of a dead bolt to two parts while said driving members by dividing the thickness of a driving member to two parts, said dead bolts are brought into engagement with said driving members to advance or retreat, and one of said driving members is driven by the thumb turn while the other by the key. An engaging means is provided between said driving members or dead bolts in such a way that said driving member driven by the thumb turn is rotated integral with the other driving member driven by the key only when the latter is rotated to lock the room. Another engaging means is provided to rotate the driving member driven by the key integral with the other driving member driven by the thumb turn when the latter is rotated from outside to unlock the room.

6 Claims, 21 Drawing Figures

LOCKING DEVICE

BACKGROUND OF THE INVENTION (a) Field of the Invention

The present invention relates to a locking device provided with switches associating with the lock of a room to guarantee security in the room left absent and to control the supply of power to the room, and more particularly, to a locking device capable of being easily locked or unlocked from inside and outside the room.

(b) Brief Description of the Prior Art

The inventor of the present invention proposed a power ON-OFF device used for security means by U.S. Pat. No. 3,803,575, German Pat. No. 2,343,594 and Japanese utility model 1,193,002. When a room is locked to leave it absent, said device is associated with the lock of room to switch on the power source to an alarm means. The alarm means is automatically made ready operation unless the lock of room is forgotten. When the room is unlocked, the power source to the alarm means is switched off causing alarm not to be sounded when window or the like of room is opened. This device is advantageous in that no fear is caused that alarm is surprisingly sounded when the power source arranged outside the room is forgetfully left ON to the alarm means and the room is unlocked to enter, which was often seen in conventional devices prior to this one. Therefore, this device is extremely useful for security means. However, assume that two or more persons are living in a room and that someone goes out but the others are present in the room. When the device is arranged in such a way that it can be operated same way from inside and outside, the power source to the alarm means is switched on associating with the lock of room from inside, so that fear will be caused that unnecessary alarm is sounded when window or the like, to which sensors are arranged, is opened by any one of persons present in the room. In addition, even if central management is tried by a central observation system arranged remote from rooms, to each of which is attached the device, it is impossible because the device can not tell whether the lock of room is done from inside or from outside, that is, whether the locked room is occupied by some persons or left absent.

In a hotel, apartment house or the like in which travellers or persons are staying or living in their respective rooms, it is essential to guarantee security and prevent any accident by recognizing whether each of rooms is occupied or absent. Therefore, each of rooms must be kept under complete observation. Further, it is also extremely important to save as much as possible the power consumed in each room by turning off the power source to each room absent, when saving-energy becomes louder these days. The locking device of the present invention is provided to meet these demands.

SUMMARY OF THE INVENTION

The present invention provides a locking device comprising driving members driven by a thumb turn from inside a room and by a key from outside the room, dead bolts brought into engagement with driving members to advance or retreat to lock or unlock the room, and switches for detecting the advance and retreat of dead bolts, wherein dead bolts are formed by dividing the thickness of a dead bolt to two parts while driving members by dividing the thickness of a driving member to two parts, dead bolts are brought into engagement with driving members to advance or retreat, and one of driving members is driven by the thumb turn while the other by the key; an engaging means is provided between two driving members or dead bolts in such a way that the driving member driven by the thumb turn is rotated integral with the other driving member driven by the key only when the latter is rotated to lock the room; and another engaging means is provided to rotate the driving member driven by the key integral with the other driving member driven by the thumb turn when the latter is rotated from outside to unlock the room, said locking device capable of being locked and unlocked from both of inside and outside the room, and allowing it to be recognized from a remote position whether the lock of a room is done from inside or from outside.

It is therefore an object of the present invention to provide a locking device provided with switches for security means associating with the lock of a room, and capable of being easily locked and unlocked from both of inside and outside the room.

Another object of the present invention is to provide a locking device capable of being locked and unlocked from both of inside and outside the room, and allowing it to be recognized from a remote position whether the lock of room is done from inside or from outside.

A further object of the present invention is to provide a locking device designed in such a way that the room power source is turned off when the room is locked from outside and on when unlocked from outside, and useful in saving power comsuption.

A still further object of the present invention is to provide a locking device allowing it to be recognized whether a room in an old people's home or apartment house in which a single person is living is occupied or absent and causing alarm to be sounded to call for patrolling when no living information is gained for a long period of time although the room is occupied.

A still further object of the present invention is to provide a locking device useful in preventing each of rooms in a hotal and the like from being wrongly used or intruded.

A still further object of the present invention is to provide a locking device allowing it to be checked from a remote position such as the front in a hotel whether the room is locked or not at the time of leaving the room absent.

These and other objects as well as merits of the present invention will become apparent from the following detailed description with reference to accompanying drawings.

BRIEF DESCRIPTION OF THE DRAWINGS

FIGS. 1*a* and 1*b* show an embodiment of locking device of the present invention, in which FIG. 1*a* is a front view of locking device and FIG. 1*b* a side view thereof with a side plate removed therefrom.

FIGS. 4*a*–4*c* are views showing the movement of a pin, in which FIG. 4*a* shows the pin when both of driving members are in the unlocked position, FIG. 4*b* shows the pin when the driving member driven by a thumb turn is being rotated and then locked, and FIG. 4c shows the pin when both of driving members are being rotated and then locked.

FIGS. 5a–5d are views showing the relation between the movement of dead bolts and reed switches, in which FIG. 5a shows dead bolts when the room is locked from inside, FIG. 5b shows dead bolts when the room is locked from outside, FIG. 5c shows dead bolts when the room is unlocked from inside, and FIG. 5d shows dead bolts when the room is unlocked from outside.

FIGS. 6a–6c are views showing the engaging means shown in FIG. 4a and arranged to dead bolts, in which FIG. 6a shows the state of pin and dead bolts when both of dead bolts are in the unlocked position, FIG. 6b shows it when the driving member driven by the thumb turn is being rotated and then locked, and FIG. 6c shows it when both of driving members are being rotated and then locked.

FIGS. 7a–7b are views showing a variation of engaging means attached to dead bolts, in which FIG. 7a shows the engaging means when both of dead bolts are in the unlocked position, FIG. 7b is a plane view showing the engaging means shown in FIG. 7a, FIG. 7c shows the engaging means when both of dead bolts are in the locked position.

DETAILED DESCRIPTION OF THE PREFERRED EMBODIMENTS

Figure 1A:
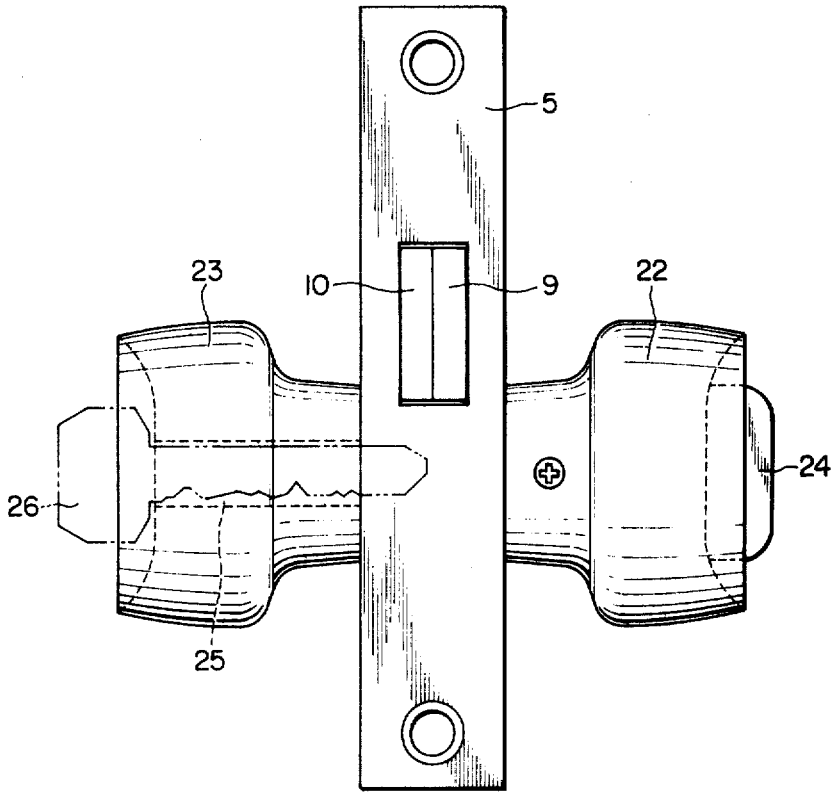
Figure 1B:
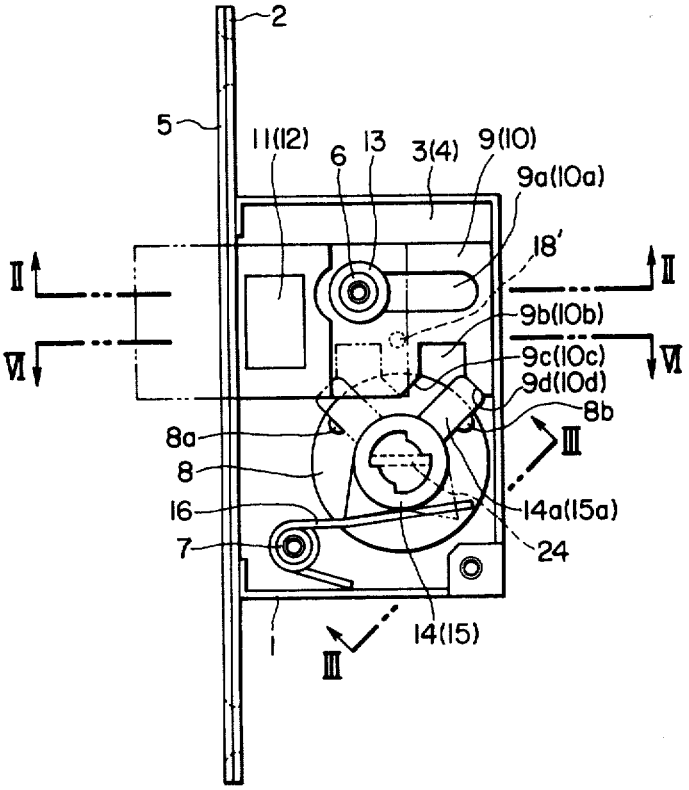

FIGS. 1a and 1b show an example of locking devices of the present invention, in which the latch bolt and its driving means are omitted for the clarity of description.

In these Figures numeral 1 represents a rectangular casing, 2 an attaching plate attached to the front of casing 1, 3 and 4 side plates attached to both sides of casing 1 (the side plate 4 is omitted in FIG. 1b), and 5 an ornamental plate attached to the front of attaching plate 2. Attaching and ornamental plates 2 and 5 are provided with screw holes common to these plates and for fixing these plates to the door. One of side plates 3 and 4 may be formed integral with the casing 1. Side plates 3 and 4 are provided with holes (not shown) into which shafts of knobs 22 and 23 are fitted, and another holes through which stoppers 8a and 8b of a holder 8 are passed. Numerals 6 and 7 denote bosses projected from the side plate 3 and each having thread screwed into the other side plate 4. Numeral 8 denotes the holder for freely rotatably holding driving members 14 and 15 and provided at both sides thereof with stopper 8a and 8b which are engaged into holes of side plates 3 and 4 to fix the holder 8 to side plates 3 and 4. Numerals 9 and 10 represent dead bolts which are formed by dividing the dead bolt to two parts and provided with slots 9a, 10a of same shape, recesses 9b, 10b, and slopes 9c, 10c, 9d and 10d. Dead bolts 9 and 10 having pieces of permanent magnet 11 and 12 embedded in the forward ends thereof, said magnets 11 and 12 serving to render operative reed switches 27 and 28, which will be later described. The boss 6 engaged through slots 9a and 10a of dead bolts 9 and 10 serves to guide dead bolts 9 and 10 forward and backward while to limit the forward and backward movement of dead bolts 9 and 10.

Figure 2:
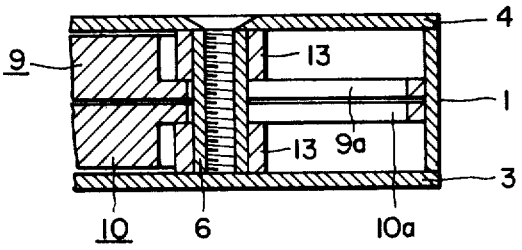
FIG. 2 is enlarged cross section taken along a line II—II in FIG. 1*b*.

As shown in FIG. 2, dead bolts 9 and 10 are held between side plates 3 and 4 by means of collars 13 fitted onto the boss 6, so that dead bolts 9 and 10 are limited in the sideward movement thereof, that is, movement in right and left directions in FIG. 1a.

Figure 3A:
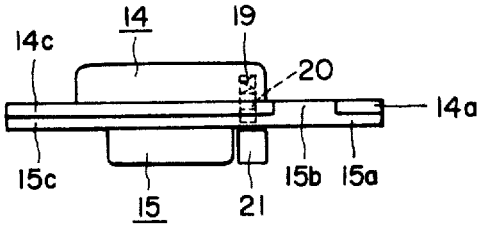
FIG. 3*a* is a side view of driving members viewed in the direction shown by a line III—III in FIG. 1*b*.
Figure 3B:
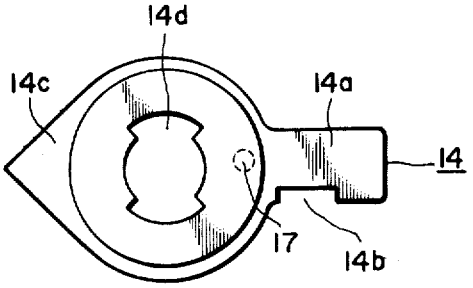
FIGS. 3*b* and 3*c* are plane views showing dismantled driving members shown in FIG. 3*a*.
Figure 3C:
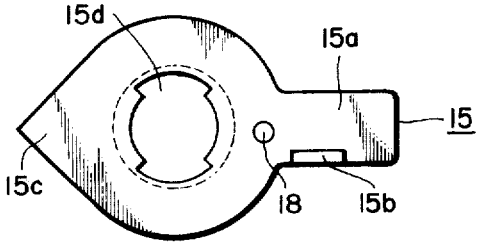

In FIGS. 3a–3c numerals 14a and 15a denote arms of driving members 14 and 15, 15b a projection formed on one side of arm 15a, 14b a recess formed on the corresponding side of arm 14a to engage with the projection 15b, 14c and 15c engaging extrusions springily supported by a spring 16 which is wound around the boss 7 as shown in FIG. 1b, and 14d and 15d holes formed in the center of driving member 14 and 15 and having stepped portions, said hole 14d being engaged with a thumb turn 24 while said hole 15d with a key 26. The center portion of each of driving members 14 and 15 is made thick and circular, and the driving member 15 is freely rotatably attached to the holder 8 fixed to the side plate 3 while the driving member 14 is freely rotatably guided by the driving member 15 with their centers aligned. The side plate 4 is further located outside driving members 14 and 15 thus assembled.

It will be now described with reference to FIGS. 4a–4c how driving members 14 and 15 are engaged with each other.

Figure 4A:
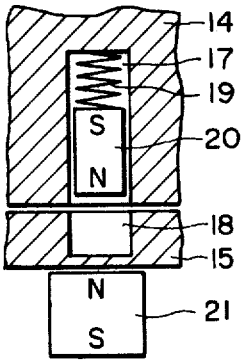

As shown in FIGS. 3a–3c and FIG. 4a, the driving member 14 is provided with a hole 17 open downward and the driving member 15 with a hole 18 open upward and facing the hole 17. A coil spring 19 and a pin 20, which is made of permanent magnet, are arranged in the hole 17 and the pin 20 is usually urged by the coil spring 19 into the hole 18. A permanent magnet 21 is fixed on the side of side plate 3 and the polarity of magnet 21 is such that the pin 20 is repulsed to come out of hole 18. Therefore, when driving members 14 and 15 are under the condition of being unlocked, they are overlapped one upon the other with the hole 17 facing the hole 18, as shown in FIG. 3a. In addition, the fixed permanent magnet 21 is located right under the aligned holes 17 and 18, so that the pin 20 is repelled and is prevented from coming out of the hole 18, as shown in FIG. 4a, thus enabling each of driving members 14 and 15 to rotate individually. However, when the driving member 15 is rotated in the locking direction, namely, counterclockwise, the projection 15b of driving member 15 is brought into engagement with the recess 14b of driving member 14, thus causing driving members 14 and 15 to rotate integral with each other. When the driving member 14 is rotated in the locking direction, namely, counter-clockwise, causing the hole 17 not aligned with the hole 18, the hole 17 is beyond the influence of magnet 21, so that the pin 20 is urged by the coil spring 19 to come out of hole 17, but stopped by the upper face of driving member 15 and forced to slide on the face of driving member 15. This is shown in FIG. 4b. If the driving member 15 is also rotated to the locked position when the driving member 14 has already been rotated to the locked position (or when both of driving members 14 and 15 are together rotated from the unlocked position to the locked position), the pin 20, which is now located beyond the influence of magnet 21 is urged by the coil spring 19 into the hole 18, as shown in FIG. 4c, to thereby make driving members 14 and 15 combined integral with each other.

Referring to FIGS. 1a and 1b again, 22 denotes the inner knob, 23 the outer knob, and 24 the thumb turn. The driving member 14 is rotated by the thumb turn 24 to move the dead bolt 9 forward and backward. Numeral 25 represents a key hole, into which the key 26 is inserted and then turned, causing the driving member 15 to rotate to move the dead bolt 10 forward and backward. FIG. 1*b* shows in a broken line the state under which the thumb turn 24 is engaged with the stepped hole.

The operation of locking device according to the present invention will be now described referring to FIGS. 5*a*–5*d*. When the room is to be locked from inside, the driving member 14 is rotated counter-clockwise by the thumb turn 24 located on the right side in FIG. 1*a*, namely, on the side of dead bolt 9. The arm 14*a* of driving member 14 is brought into engagement with the recess 9*b* of dead bolt 9 to move the dead bolt 9 in the left direction in FIG. 1*b*. The slot 9*a* is guided by the boss 6 at this time. The rotating arm 14*a* is contacted with and stopped by the stopper 8*a* of holder 8, engaging with the slope 9*c*, to finish the lock of locking device, where the dead bolt 9 is projected to a position shown by a two-dotted line in FIG. 1*b*. The reed switch 27 is rendered operative by the permanent magnet 11 this time to give information, by which it can be recognized that the lock finished has been done from inside. This is the state of lock shown in FIG. 5*a*.

When the lock done from inside is to be unlocked from inside, the operation becomes inverse to the locking operation. Namely, when the driving member 14 is rotated clockwise by the thumb turn 24, the arm 14*a* engaged with the recess 9*b* to move the dead bolt 9 in the right direction in FIG. 1*b*. The arm 14*a* is contacted with and stopped by the stopper 8*b* of holder 8, engaging with the slope 9*d* of dead bolt 9, to finish the unlocking operation. This is shown in FIG. 5*c*.

When the door is to be locked from outside leaving the room absent, the key 26 is inserted into the key hole 25 from the left side in FIG. 1*a* and turned counter-clockwise in FIG. 1*b*. The driving member 15 is driven with its projection 15*b* is then engaged with the recess 14*b* of driving member 14 allowing both of driving members 14 and 15 to rotate integral with each other, and when a little further turned counterclockwise in FIG. 1*b*, both of driving members 14 and 15 are further firmly locked integral with each other by the pin 20 urged into the hole 18. Arms 15*a* and 14*a* are engaged with recesses 10*b* and 9*b* moving both of dead bolts 10 and 9 in the left direction to finish the lock of door in same way as described above, where both of dead bolts 10 and 9 are projected to the position shown by the two-dotted line in FIG. 1*b*. Reed switches 27 and 28 are rendered operative by permanent magnets 11 and 12 this time to give information telling the lock of door to be done from outside. It is the state of dead bolts shown in FIG. 5*b*.

When the door locked from outside is to be unlocked from outside, the key 26 is inserted into the key hole 25 and turned clockwise in FIG. 1*b*. Driving members 14 and 15 locked integral with each other by the pin 20 urged into the hole 18 are rotated moving both of dead bolts 9 and 10 to a position shown by a solid line in FIG. 1*b* to unlock the door. This is the state of dead bolts shown in FIG. 5*b*.

Figure 5A:
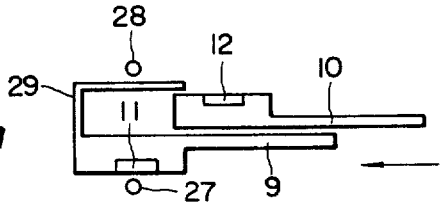
Figure 5B:
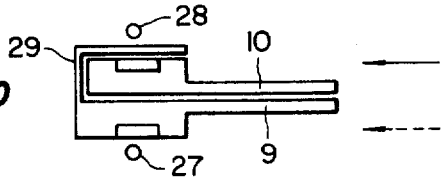
Figure 5C:
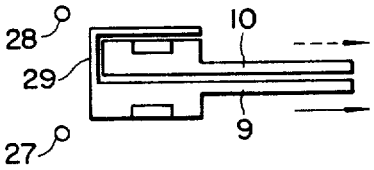
Figure 5D:
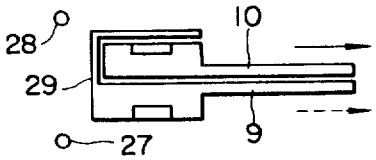

It is usual for reed switches 27 and 28 shown in FIGS. 5*a*–5*b* to be arranged in the fixed side such as a pillar into which dead bolts 9 and 10 are projected when the door having the locking device of the present invention mounted therein is locked, but reed switches 27 and 28 may be arranged in the casing 1 in such a way that they are opened when being under the influence of permanent magnets 11 and 12 but closed when being escaped from the influence of magnets 11 and 12 by the lock of door. However, it is enough for reed switches 27 and 28 to serve to detect whether or not the door is locked, and therefore they may be of such type that they are usually closed. Further, they are not limited to reed switches 27 and 28, but other switches, or sometimes micro-switches, may be employed. In the case of embodiment of the present invention shown in FIG. 1*a*, it can be seen from outside when the door is opened that the dead bolt is divided to two parts 9 and 10. It is therefore desirable to arrange a cover to the foremost end of dead bolt 9. In FIGS. 5*a*–5*d* numeral 29 represents a cover made of non-magnetic material same as that of dead bolt 9, such as stainless steel, aluminium and plastics, and said cover corresponds to the projection 15*b* shown in FIGS. 3*a* and 3*c* serves to enhance the strength of dead bolt 9 when it only is used to lock the door.

Figure 4B:
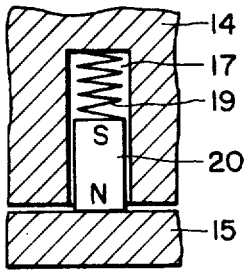
Figure 4C:
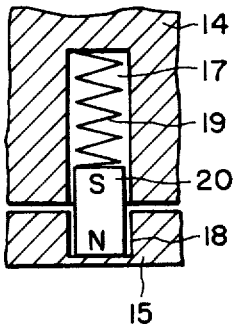
Figure 6A:
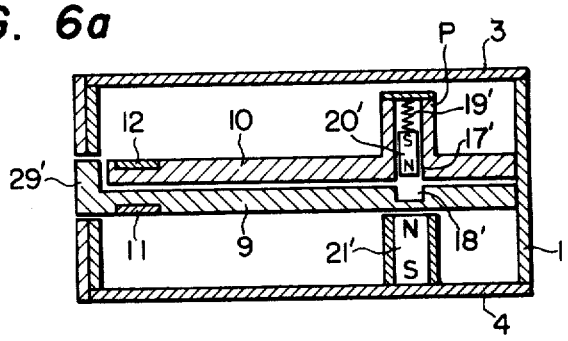
Figure 6B:
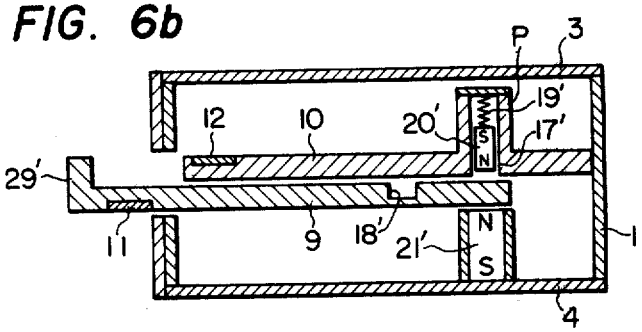
Figure 6C:
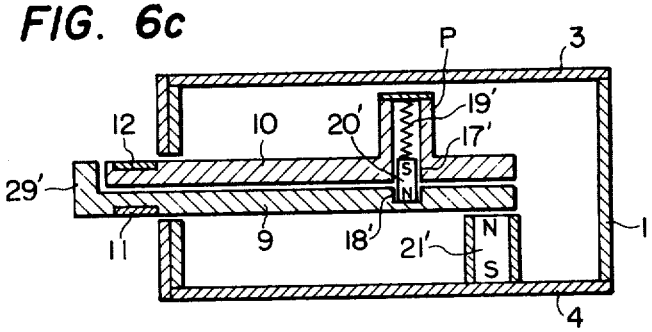

FIGS. 6*a*–6*c* show another example of engaging means between driving members 14 and 15 shown in FIGS. 4*a*–4*c*, which are cross-sectional views taken along a line VI—VI in FIG. 1*b*, said example attached to dead bolts 9 and 10 comprising a hole 17' penetrating through the dead bolt 10 and communicating with the hollow portion of a projection (p), a coil spring 19' and a pin 20' of permanent magnet being inserted into the hole 17', a hole 18' formed in the dead bolt 9 provided with a cover 29' and facing the hole 17' of the dead bolt 10, and a permanent magnet 21' fixed on the side plate 4.

When the door is not locked, the pin 20' is held inside the hole 17' of dead bolt 10 leaving the hole 18' of dead bolt 9 vacant, as shown in FIG. 6*a*, that dead bolts 9 and 10 are kept movable individually.

When the door is locked from inside, only the dead bolt 9 moves as shown in FIG. 6*b*, while when the door is unlocked from inside, it also independently moves to return to the position shown in FIG. 6*a*.

When the door is locked from outside, the dead bolt 10 is projected forcing the cover 29' of dead bolt 9 to move therewith and causing the pin 20' to be urged into the hole 18' of dead bolt 9, as shown in FIG. 6*c*. Therefore, when the door is unlocked from outside, dead bolts 9 and 10 engaged with each other by the pin 20' move as a unit to return to the position shown in FIG. 6*a*.

Figure 7A:
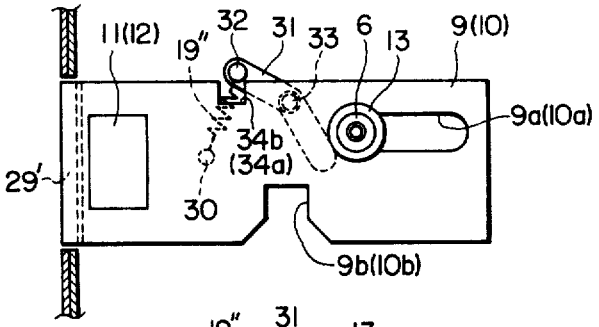
Figure 7B:
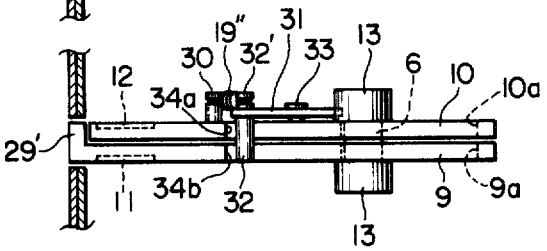

FIGS. 7*a*–7*d* show a further example of engaging means between dead bolts 9 and 10, said example comprising a spring 19'', a rotary lever 31 and a recess 34*a*, an end of spring 19'' being attached to a rod 30 fixed on the dead bolt 10 while the other end thereof being fixed or hung to an end 32' of a pin 32 projected from one end of lever 31, said lever 31 being arranged to the dead bolt 10 in such a way that it rotates around a point 33 of support with the other end thereof contacted with the collar 13, and said recess 34*a* receiving the pin 32. In FIGS. 7*a* and 7*b* the spring 19'' is extended urging the pin 32 to come out of recess 34*a*. The dead bolt 9 is also provided with a recess 34*b* corresponding to the recess 34*a* and with a cover 29' same as the one shown in FIGS. 6*a*–6*c*.

When the door is locked from inside, the pin 32 is kept outside the recess 34*b* of dead bolt 9 as shown in FIG. 7*a*, so that the dead bolt is independently moved in the left direction in FIG. 7*a* to lock the door, leaving the dead bolt 10 in the unlocked position thereof. When the door is unlocked from inside, the dead bolt 9 is moved as a unit in the right direction in FIG. 7*a* to unlock the door.

When the door is locked from outside, the dead bolt 10 is moved in the left direction in FIG. 7*a* urging the cover 29' of dead bolt 9 to move therewith, although the pin 32 is kept outside the recess 34a of dead bolt 10. When dead bolts 9 and 10 are on the way of being moved like this in the left direction in FIG. 7a, the pin 32 is urged into recesses 34a and 34b of dead bolts 9 and 10 by the action of spring 19" at the time when the lever 31 is released from the collar 13, and dead bolts 9 and 10 with the pin 32 inserted in recesses 34a and 34b are further moved integral with each other to lock the door, which is the state of dead bolts shown in FIG. 7c.

Figure 7C:
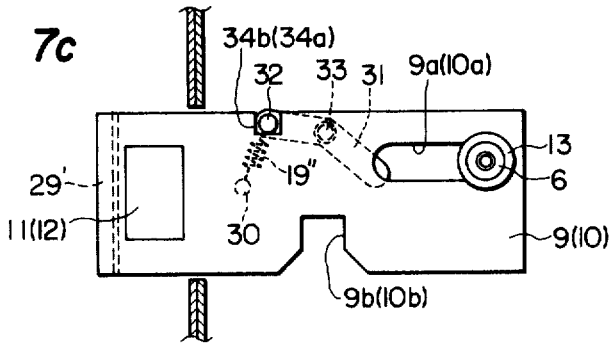
Figure 7D:
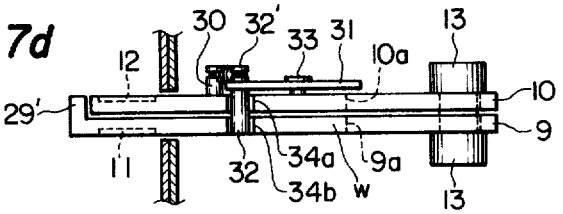
FIG. 7d is a plane view showing the engaging means shown in FIG. 7c.

When the door is unlocked from outside, the dead bolt 10 is moved integral with the dead bolt 9 in the right direction in FIG. 7c because the pin 32 is kept inside recesses 34a and 34b of dead bolts 9 and 10, and the pin 32 is then urged to come out of recesses 34a and 34b at the time when the end of lever 31 is contacted with and forced by the collar 13 to rotate around the point 33 of support, and dead bolts 9 and 10 are further moved keeping the pin 32 outside recesses 34a and 34b to the unlocked position shown in FIG. 7a.

Referring to this example of engaging means between dead bolts 9 and 10, or driving member 14 and 15, one of features of the present invention will be described that the door must be first locked and then unlocked by the key from outside to unlock from outside the door once locked from inside. (see FIG. 5a) When the door is locked by the thumb turn from inside, the pin 32 of lever 31 is slided on and along the upper edge (w) of dead bolt 9 shown in FIG. 7d during the process of locking the door from outside, and then urged into recesses 34a and 34b at the time when the lock of door from outside is finished, that is, recesses 34a and 34b are overlapped with each other. It is possible only under this state to move from outside the dead bolt 10 in the right direction in Figures forcing the dead bolt 9 to move therewith to the unlocked position shown in FIG. 7a.

Each member of engaging means shown in FIGS. 6a and 7a may be arranged to any of dead bolts 9 and 10, and if one of engaging means shown in FIGS. 6a and 7a is employed, it becomes unnecessary to use members such as recess 14b, projection 15b and pin 20 which are arranged to driving members 14 and 15.

Figure 8:
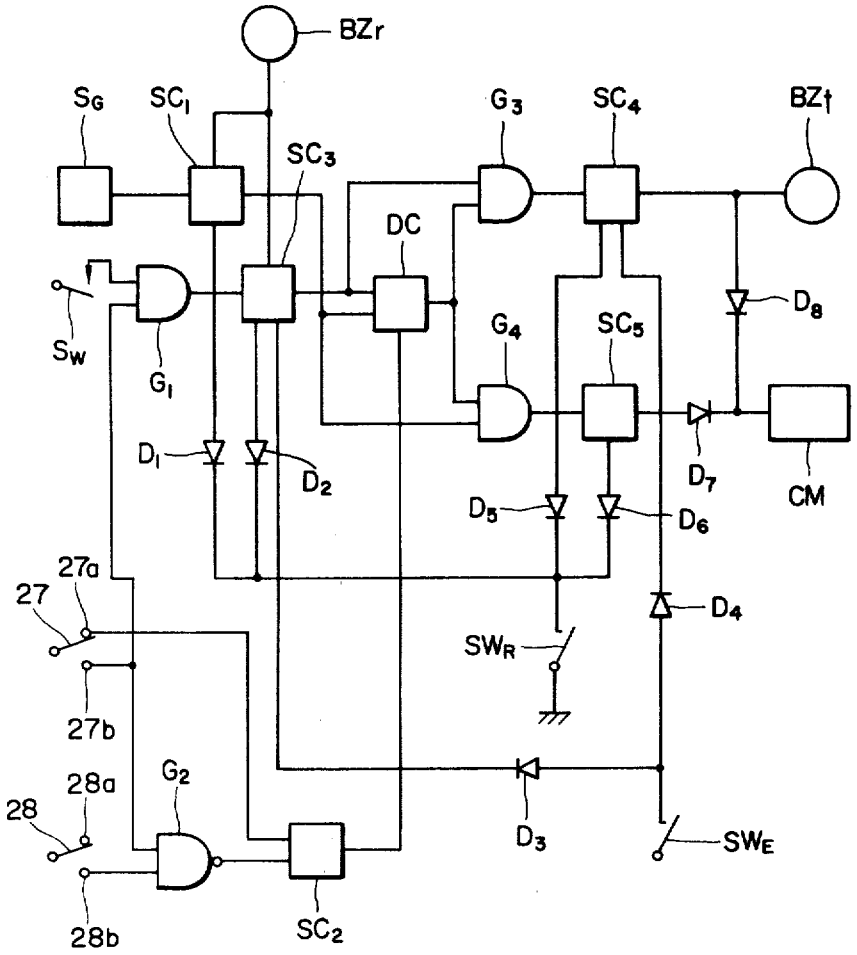
FIG. 8 is a circuit diagram showing how the present invention is used.

Referring to FIG. 8, it will be described how the locking device of the present invention is used.

In the Figure numeral 27 and 28 represent reed switches shown in FIGS. 5a–5d, said reed switches contacting with contacts 27a and 28a, respectively, when the door is not locked, and with contacts 27b and 28b when the door is locked. $G_1$, $G_3$ and $G_4$ denote AND gates, $G_2$ a NAND gate, $SC_1$–$SC_3$ set circuits capable of performing setting and resetting operation, DC a delay circuit for performing delay operation only when receiving an input from the set circuit $SC_2$ but otherwise letting inputs pass therethrough $BZ_r$ and $BZ_f$ buzzers attached in the room and to the porch, respectively, $D_1$–$D_8$ diodes, $SW_R$ a reset switch $SW_E$ an emergency switch, $S_G$ a gas sensor, $S_w$ a window sensor, and CM a center pbservation device.

When the door is locked from inside, only the reed switch 27 is rendered operative but the reed switch 28 is not, so that an output is sent from the NAND gate $G_2$. The set circuit $SC_2$ is set and the delay circuit DC performs delay operation. The AND gate $G_1$ is opened by an input sent from the contact 27b when the reed switch 27 is operated. If one of windows should be left open, an output is fed from the window sensor $S_w$ to the AND gate $G_1$, so that the set circuit $SC_3$ is set to cause the room buzzer $BZ_r$ to sound. At the same time the output of set circuit $SC_3$ is also applied to the AND gate $G_3$, but the other input of this AND gate $G_3$ is delayed for a certain time because the output of set circuit $SC_3$ is applied to the gate $G_3$ through the delay circuit DC. Therefore, the gate $G_3$ does not give an output at once, thus preventing the porch buzzer $BZ_f$ from sounding at once or information from being sent at once to the center observation device. Namely, if the room buzzer $BZ_r$ sounds at the same time when the door is locked from inside, it tells that any one of windows is left open. Accordingly, the window may be closed at once, or the door may again be locked after it is unlocked and the window is closed.

When the door is locked from outside, both of reed switches 27 and 28 are operated, so that no output is sent from the NAND gate $G_2$ and the set circuit $SC_2$ is reset, thus causing the delay circuit DC not to be operated. If one of windows should be left open, the porch buzzer $BZ_f$ is therefore sounded at once. It can be therefore understood at once from outside that any one of windows is left open. The door may again be locked after it is unlocked and the window is closed. If it is desired that information is not sent at once to the center observation device CM, another delay circuit may be arranged through which information is passed.

If gas should leak in the room when the room is left absent, particularly when the room is locked from outside, the gas sensor $S_G$ is operated to set the set circuit $SC_1$, cause room and porch buzzers $BZ_r$ and $BZ_f$ to sound, and send information to the center observation device CM. Upon the operation of this gas sensor $S_G$, the set circuit $SC_1$ is usually kept ready for operation regardless of reed switches 27 and 28. Set circuits $SC_1$, $SC_3$, $SC_4$ and $SC_5$ are reset by the reset switch $SW_R$. When the emergency switch $SW_E$ is put ON, set circuits $SC_3$ and $SC_4$ are set and room and porch buzzers $BZ_r$ and $BZ_f$ are sounded, thus informing the occurrence of danger.

Dead bolts 9 and 10 are formed by dividing the thickness of dead bolt to two parts as shown in FIG. 1a, but they may be formed by dividing the width of dead bolt to two parts. The thumb turn may be arranged outside the door while the key may be used inside the door. Thumb turns or keys may be used to both sides.

As described above in detail, according to the present invention the thickness of dead bolt used in a locking device is divided to two parts, and the driving member to drive these dead bolts is also formed to consist of two driving members. The lock of door from inside is attained by one of dead bolts, the door lock from outside by two dead bolts, and when the locking device, locked from inside, is unlocked from inside, one dead bolt moves. When the locking device, locked from the outside, is locked from outside or inside, two dead bolts move. When the locking device, locked from the inside, is unlocked from the outside, it is unlocked after the outside locking bolt is once locked from outside, thus causing one dead bolt to be moved first and then two bolts to be moved. Therefore, it can be easily understood whether the door is locked from outside or inside by arranging switches for detecting the advance and retreat of each of dead bolts. The locking device of the present invention is therefore extremely effective in achieving security, saving of energy and the like.

The locking device of the present invention can be used, for example, for the saving of energy in such a way that the power source is turned OFF when the room is locked from outside to thereby save energy at the time when the room is left absent while turned ON when the room is unlocked to enter the room, but not turned OFF when the room is locked or unlocked from inside.

The locking device of the present invention is also effective in achieving security. For example, when each room in a hotel is locked from inside, the door is not opened even if a third person such as intruder and wicked employee tries to unlock the door by its passkey to drive from outside the dead bolt 10 in the unlocking direction. Namely, because the dead bolt 9 locked from inside can not be moved from outside, it is a must that the dead bolt 10 is first brought into the locked position (see FIGS. 5*a* and 5*b*). If a circuit is set to sound alarm in the room when the dead bolt 10 is brought into the locked position like this, intrusion into the room can be prevented. Even if the person having the passkey is the room-mate, his entrance into the room from outside can be recognized from inside by the alarm sound.

Assume, for example, that the lodger in a hotel hands his key to the front when he temporarily goes out of hotel. The front then turns ON the alarm circuit associated with his room. If any intruder tries to enter his room, alarm will be sounded. It can also be checked whether he forgets locking his room or not if alarm is sounded at once when the alarm circuit is turned ON by the front.

If a circuit is set to sound alarm when a third person such as intruder and wicked employee locks from inside the door of a vacant room from which its guest has checked out, the wrong use of room can be checked.

The locking device of the present invention can be relatively easily assembled into the conventional locking device already attached.

Dead bolts shown in FIGS. 5*a*–5*d* may be arranged in such a way that the dead bolt 9 is moved by outside lock while the dead bolt 10 by inside lock. Such arrangement also enables it to be judged whether the door is locked from inside or from outside, and can also be used for the saving of energy as described above.

When the locking device of the present invention is attached to the old people's home or apartment house, it can be understood that a room is occupied if its door is locked from inside. If no living information telling the use of toilet room or the lighting of lamps is gained after 8–12 hours have passed from the time when the room door was locked, it can be understood that patrolling or so is needed in view of an accident. When an old person is living in a room, a sensor for detecting the opening of toilet room door or the use of water in the toilet room is arranged in the room. A circuit is set to sound alarm when no information is gained from the sensor during the lapse of 8–12 hours. Upon the sounding of alarm a nursing person can go out at once to see the room.

When the toilet room is used, the sensor detects it to reset a timer. When the room is locked from outside by its resident to leave the room vacant, the timer is turned zero and stopped. When the room is unlocked from outside and then locked from inside, the timer is reset to operate. If thus arranged, alarm is accurately sounded.

As apparent from the above, the locking device of the present invention becomes more important when rooms in a building or so tend to be kept under central observation.

I claim:

1. In a locking device of the type comprising driving members driven by a thumb turn from inside a room and by a key from outside the room, dead bolts brought into engagement with the driving members to advance or retreat to lock or unlock the room, and switches for detecting the advance and retreat of the dead bolts, the improvement wherein said dead bolts are formed by dividing the thickness of a dead bolt into two parts and said driving members are formed by dividing the thickness of a driving member into two parts, said dead bolts being brought into engagement with said driving members to advance or retreat, and one of said driving members is driven by the thumb turn and the other by the key; said device further comprising a first engaging means for providing that said driving member driven by the thumb turn is rotated integrally with the other driving member driven by the key only when the key is rotated to lock the room, and a further engaging means for providing rotation of the driving member driven by the key integrally with the other driving member driven by the thumb turn when the room is unlocked after having been locked from the inside by means of said thumb turn.

2. A locking device according to claim 1 wherein said dead bolts are made of non-magnetic material and wherein a piece of permanent magnet is embedded in the outer side end of each of said dead bolts so as to render said switches operative.

3. A locking device according to claim 1 wherein when the room is locked from inside using the dead bolt which serves to lock the room from inside, the room cannot be unlocked from outside until the other dead bolt which serves to lock the room from outside is first moved to the locked position.

4. A locking device according to any one of claims 1, 2 or 3 wherein said further engaging means includes a coil spring, a pin made of permanent magnet, and a permanent magnet, said spring and pin being arranged in a hole formed in one of said driving members and said pin being urged into a corresponding hole formed in the other of said driving members, and said permanent magnet being positioned in such a way that the pin is repulsed by the permanent magnet to come out of the corresponding hole formed in the other of said driving members when said driving members are in the unlocked position; and said first engaging means includes a recess formed in one of said driving members and a projection projected from the other of said driving members.

5. A locking device according to any one of claims 1, 2 or 3 wherein said further engaging means includes a coil spring, a pin made of permanent magnet, and a permanent magnet, said spring and pin being arranged in a hole penetrating through one of said dead bolts and communicating with the hollow portion of a projection projected from said dead bolt and said pin being urged by the spring into a corresponding hole formed in the other of said dead bolts, and said permanent magnet being positioned in such a way that the pin is repulsed by the magnet to come out of the corresponding hole formed in the other of said dead bolts when said dead bolts are in the unlocked position; and said first engaging means includes a cover provided at the foremost end of one of said dead bolts and formed integrally with said dead bolt.

6. A locking device according to any one of claims 1, 2 or 3 wherein said further engaging means includes a spring, a rotary lever and a pin projected from said lever, said spring and lever being attached to one of said dead bolts in such a way that the pin is forced to come out of recesses formed in same location of said dead bolts when said dead bolts are in the unlocked position; and said first engaging means includes a cover provided at the foremost end of one of said dead bolts and formed integrally with said dead bolt.

* * * * *